US008961341B2

(12) United States Patent
Dickerson

(10) Patent No.: US 8,961,341 B2
(45) Date of Patent: Feb. 24, 2015

(54) SELF-LOCKING ARCHERY ARROW FIELD TIP OR BROADHEAD AND ARROW INSERT

(76) Inventor: Larry Max Dickerson, Argyle, TX (US)

( * ) Notice: Subject to any disclaimer, the term of this patent is extended or adjusted under 35 U.S.C. 154(b) by 133 days.

(21) Appl. No.: 13/345,652

(22) Filed: Jan. 6, 2012

(65) Prior Publication Data

US 2012/0178559 A1 Jul. 12, 2012

Related U.S. Application Data

(60) Provisional application No. 61/460,916, filed on Jan. 10, 2011, provisional application No. 61/460,917, filed on Jan. 10, 2011.

(51) Int. Cl.
*F42B 6/08* (2006.01)

(52) U.S. Cl.
CPC ..... *F42B 6/08* (2013.01)
USPC ..... 473/582; 473/583

(58) Field of Classification Search
CPC ..... F24B 6/003; F24B 6/02; F24B 6/04; F24B 6/06; F24B 6/08
USPC ..... 473/578, 582, 583, 585, 586
See application file for complete search history.

(56) References Cited

U.S. PATENT DOCUMENTS

| | | | | |
|---|---|---|---|---|
| 3,554,258 | A * | 1/1971 | Duffy | 411/301 |
| 3,568,746 | A * | 3/1971 | Faroni et al. | 411/302 |
| 4,138,113 | A * | 2/1979 | Sheldon, Jr. | 473/586 |
| 4,191,677 | A * | 3/1980 | Strand | 521/54 |
| 5,114,156 | A * | 5/1992 | Saunders | 473/582 |
| 5,921,875 | A * | 7/1999 | Bickel | 473/582 |
| 7,651,421 | B2 * | 1/2010 | Smith et al. | 473/582 |
| 7,883,435 | B2 | 2/2011 | Sullivan | |
| 8,016,703 | B1 | 9/2011 | Kronengold et al. | |

* cited by examiner

*Primary Examiner* — John Ricci
(74) *Attorney, Agent, or Firm* — Braxton, Hilton & Perrone, PLLC

(57) ABSTRACT

A self-locking archery arrow field tip or broadhead and arrow insert that provides prevailing torque to offset rotational and vibrational forces applied to the arrow tip when released from a bow. A nylon polymer chemically or thermally applied to a threaded field tip or broadhead or a threaded arrow insert provides a detachable and reusable self-locking arrow tip or arrow insert.

18 Claims, 2 Drawing Sheets

SELF-LOCKING ARCHERY ARROW FIELD TIP OR BROADHEAD AND ARROW INSERT

CLAIM TO PRIORITY

This patent application claims the benefit pursuant to 35 U.S.C. §119(e) of U.S. provisional patent application No. 61/460,916, filed Jan. 10, 2011 and U.S. provisional patent application No. 61/460,917, filed Jan. 10, 2011.

TECHNICAL FIELD OF THE INVENTION

This invention relates, in general, to an improved archery arrow field tip or broadhead having a nylon polymer coating applied to a threaded portion of the field tip or broadhead or to an associated internal thread of an arrow insert. The coated field tip or broadhead is inserted into a mating threaded portion of an arrow insert to provide a self-locking tip. The field tip or broadhead is inserted into a coated mating threaded portion of an arrow insert to provide a self-locking tip.

BACKGROUND

Numerous arrows, arrow systems and bow and arrow systems have been developed for use in hunting and sport archery. Traditionally, arrow systems embody an arrow shaft, an arrow point, such as a field tip or a broadhead, that is permanently or removably attached to the leading or distal end of the arrow shaft. A conventional arrow system also includes a nock provided at the trailing or proximate end of the arrow shaft and a plurality of vanes or other fletching are also typically secured to the trailing end of the arrow shaft to affect proper arrow flight.

Conventional field tip arrow systems include a field tip that may be removably attached to the arrow shaft using one or more insert components. In one type of field tip system, an insert having a shank portion, a lip portion, and a threaded end portion may be attached to a hollow portion of an arrow shaft by inserting the shank portion into the hollow arrow shaft until the lip portion of the insert abuts an end wall of the arrow shaft. A field tip having a threaded portion may then be threaded into the threaded end of the insert until the end wall of the field tip is seated against the lip portion of the insert. Attaching the field tip to the arrow shaft in this removable manner enables archers to use various field tips and arrow shafts as may be required for various hunting or sport archery applications. Field tips, also referred to as field points, include target tips, target points, practice tips and practice points.

Along these lines, in broadhead arrow systems, a broadhead typically includes a shank portion having a threaded trailing end. The broadhead is attached to the arrow shaft by threading the threaded trailing end of the shank portion into a threaded bore located in the hollow arrow shaft or an arrow insert. Attaching the broadhead to the arrow shaft in this removable manner enables archers to use various broadheads and arrow shafts as may be required for differing hunting or sport archery applications.

Broadheads, in general, are of a construction similar to that of a field tip insofar as the broadhead includes a shaft having a threaded end for removable insertion into an arrow shaft. Broadheads may be composed of a plurality of components, including a threaded portion designed to mate or to be engaged with a threaded arrow insert.

In conventional arrow systems, whether employing a field tip or broadhead, an arrow insert serves as an interface between the field tip or broadhead and the arrow shaft.

In conventional field tip and broadhead arrow systems, a common drawback is the loosening and potential exit of the field tip or broadhead from its position within the arrow insert in the arrow shaft. This loosening is typically caused by horizontal and vertical rotational forces applied to the field tip or broadhead as well as vibrational energy produced during arrow flight. Although precise aligning of the field tip or broadhead enables optimal arrow flight and performance, the loosening of the field tip or broadhead is not eliminated by tuning and aligning. Ultimately, field tip or broadhead loosening remains as a major annoyance and inconvenience to archers. Archers, both experienced and novice, must check and recheck that the field tip or broadhead is secured before each shot. Failure to do so impacts performance and results in the loss of field tips or broadheads, which increases user cost and decreases user enjoyment. What is needed is a field tip or broadhead arrow system that eliminates the negative impact on performance and enjoyment resulting from these rotational and vibrational forces.

SUMMARY

The shortcomings of existing archery arrow tip and arrow inserts are overcome by the herein disclosed self-locking archery arrow field tip or broadhead and arrow insert. A self-locking field tip or broadhead having a shaft and threaded end that is sized to be detachably engaged to an arrow insert is disclosed. A nylon polymer, such as a nylon patch or suitable chemical substitute is applied to the threaded end of the arrow tip as a coating. The coating provides for engagement of the field tip or broadhead to an arrow insert in a manner that permits use and reuse of the coated arrow tip threading while at the same time providing the necessary prevailing torque to offset vibrational or rotational forces acting upon an arrow when released from a bow. These vibrational and rotational forces cause the arrow tip to become loose from the arrow insert, requiring repeated tightening by the operator.

A self-locking arrow insert is also disclosed having an internal bore section and internal threaded section sized to be detachably engaged to a threaded end of an arrow tip, such as a field tip or broadhead.

BRIEF DESCRIPTION OF THE DRAWINGS

Claimed subject matter is particularly pointed out and distinctly claimed in the concluding portion of the specification. However, such subject matter may be understood by reference to the following detailed description when read with the accompanying drawings.

Figure 1:
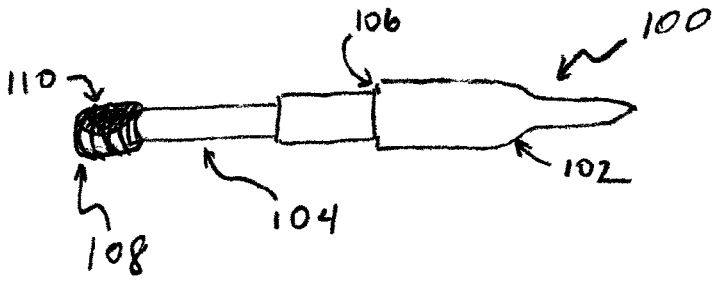
FIG. 1 is a diagram of a field tip in accordance with one or more embodiments.

It will be appreciated that for simplicity and/or clarity of illustration, elements illustrated in the figures have not necessarily been drawn to scale. For example, the dimensions of some of the elements may be exaggerated relative to other elements for clarity. Further, if considered appropriate, reference numerals have been repeated among the figures to indicate corresponding and/or analogous elements.

DETAILED DESCRIPTION OF THE EMBODIMENTS

In the following detailed description, numerous specific details are set forth to provide a thorough understanding of claimed subject matter. However, it will be understood by those skilled in the art that claimed subject matter may be practiced without these specific details. In other instances, well-known methods, procedures, components and/or techniques have not been described in detail.

Referring to FIG. 1, an embodiment of the present self-locking archery arrow field tip is provided. In one embodiment, field tip 100 comprises a single piece construction having multiple sections. Field tip 100 includes tip portion 102 and shaft portion 104. Tip end wall 106 is located at the arrow shaft facing end of tip portion 102. A threaded end portion 108 is located at the end of shaft portion 104 as shown in FIG. 1.

Figure 2:
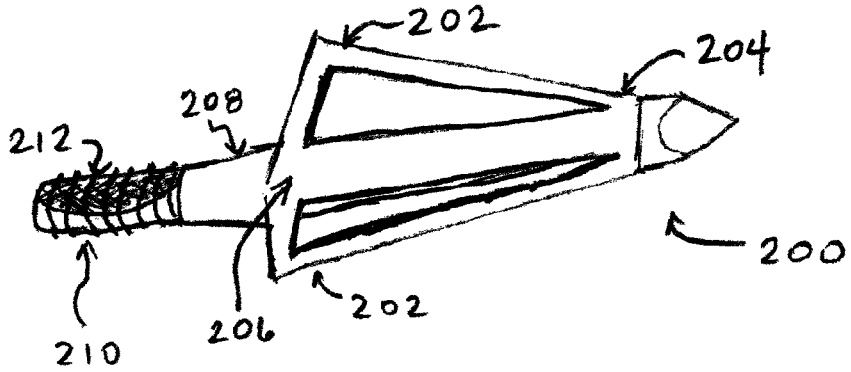
FIG. 2 is diagram of a broadhead in accordance with one or more embodiments.

Referring to FIG. 2, an embodiment of a conventional single piece broadhead is depicted. Broadhead 200 includes multiple blades 202 extending from a common frontal point 204 to a base 206, a shaft portion 208 and a threaded end 210. More complex broadheads, such as those having multiple parts and a ferrule are also available.

Figure 3:
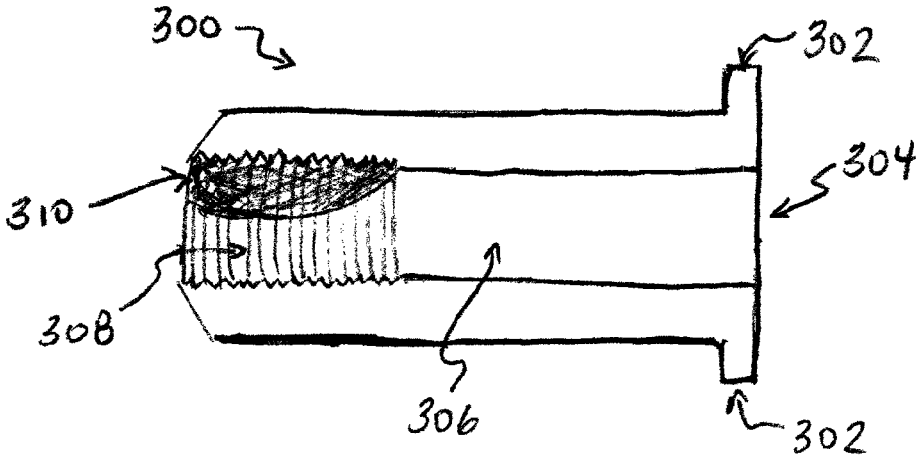
FIG. 3 is a diagram of an arrow insert in accordance with one or more embodiments.

Referring to FIG. 3, an embodiment of the present self-locking archery arrow insert is shown. In one embodiment, arrow insert 300 comprises a lip portion 302 located at a front end 304 of arrow insert 300, an internal bore portion 306 and a threaded end 308 of internal bore portion 306. Internal bore portion 306 of arrow insert 300 is formed of a size to receive shaft portion 104 of field tip 100 or shaft portion 208 of broadhead 200. The threaded end 308 of arrow insert 300 is sized to receive the threaded end portion 108 of field tip 100 or threaded portion 210 of broadhead 200.

Figure 4:
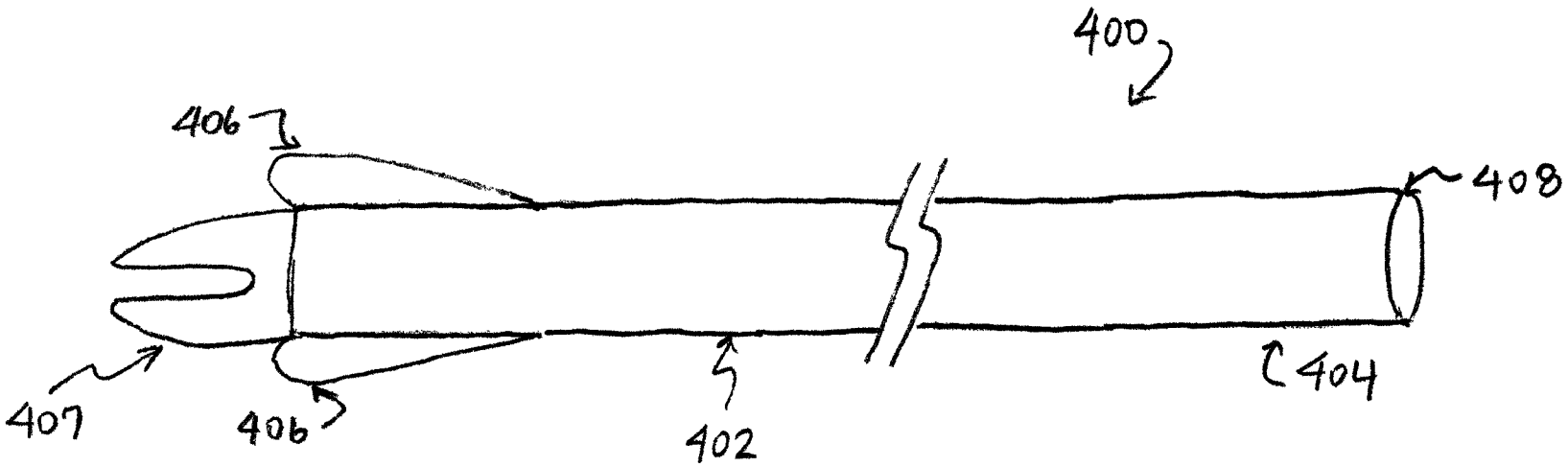
FIG. 4 is a diagram of an arrow system in accordance with one or more embodiments.

Referring to FIG. 4, an embodiment of a self-locking archery field tip and arrow insert system is shown. In one embodiment, arrow 400 includes an arrow shaft 402 having a forward end 404, a fletching end 406 and nock 407. Forward end 404 includes and end wall 408. Arrow shaft 402 is hollow. Forward end 404 of arrow 400 is of a diameter sufficient to receive arrow insert 300. Specifically, threaded end 308 of arrow insert 300 is inserted first into forward end 404 of arrow shaft 402 until lip portion 302 of arrow insert 300 abuts end wall 408, preventing further entry of arrow insert 300 into arrow shaft 402.

Once arrow insert 300 is fully installed into arrow shaft 402, field tip 100 may be installed. Field tip 100 is installed by inserting threaded end portion 108 into the internal bore portion 306 of arrow insert 300. Field tip 100 is rotated within arrow insert 300 to engage the threaded end 108 of field tip 100 with threaded end 308 of arrow insert 300.

Alternatively, following installation of arrow insert 300 into arrow shaft 402, broadhead 200 may be installed. Broadhead 200 is installed by inserting threaded end 210 into the bore portion 306 of arrow insert 300. Broadhead 200 is rotated within arrow insert 300 to engage the threaded end 210 of broadhead 200 with threaded end 308 of arrow insert 300.

In order to minimize or eliminate the loosening effect of rotational and vibratory forces on arrow 300 and specifically on field tip 100, in one embodiment a nylon polymer coating, such as a nylon patch is applied to a part or all of threaded end 108 of field tip 100. The application of the nylon polymer to the threaded end 108 of field tip 100 is shown in FIG. 4. Referring again to FIG. 1, in this embodiment nylon polymer 110 is applied to a portion of threaded end 108 of field tip 100. In the alternative, nylon polymer 110 may be applied thermally or chemically to the entire threaded surface area of threaded end 108 of field tip 100, providing 360 degree coverage. Upon installing field tip 100 into arrow insert 200 as described above, when arrow 300 is released from a bow, the nylon polymer at the junction of threaded end 108 of field tip 100 with threaded section 308 of arrow insert 300 creates a prevailing torque that sufficiently eliminates any rotational or vibratory forces that otherwise cause loosening of field tip 100 from arrow insert 300. The pre-applied nylon polymer does not act as a glue or fastener that permanently affixes field tip 100 to arrow insert 300. Instead, the nylon polymer provides the necessary prevailing torque to counter vibrational and rotational forces on the field tip while at the same time permitting removal and re-use of field tip 100 by the user. Over time, field tip 100 may become worn or damaged as a result of normal use. After the nylon polymer is applied, the user may nevertheless remove field tip 100 and replace it as desired.

Similarly, to minimize or eliminate the loosening effect of rotational and vibratory forces on arrow 300 and specifically on broadhead 200, in one embodiment a nylon polymer coating is applied to a part or all of threaded end 210 of broadhead 200. Specifically, a nylon polymer, such as a nylon patch, is pre-applied to broadhead 200 either thermally or chemically to a section of threaded end 210. In the alternative, a chemical substitute that offers the same properties as the nylon patch in terms of repeatable use and removability may be applied. The application of the nylon polymer to the threaded end 210 of broadhead 200 is shown in FIG. 2. Referring again to FIG. 2, in this embodiment nylon polymer 212 is applied to a portion of threaded end 210 of broadhead 200. In the alternative, nylon polymer 212 may be applied thermally or chemically to the entire threaded surface area of threaded end 210 of broadhead 200, providing 360 coverage. Upon installation of broadhead 200 into arrow insert 300 as described above, when arrow 400 is released from a bow, the polymer at the junction of threaded end 210 of broadhead 200 with threaded section 308 of arrow insert 300 creates a prevailing torque that sufficiently eliminates any rotational or vibratory forces that otherwise cause loosening of broadhead 200 from arrow insert 300. The pre-applied nylon polymer does not act as a glue or fastener that permanently affixes broadhead 200 to arrow insert 300. Instead, the nylon polymer provides the necessary prevailing torque to counter vibrational and rotational forces on the broadhead while at the same time permitting removal and re-use of broadhead 200 by the user. Over time, broadhead 200 may become worn or damaged as a result of normal use. After the nylon polymer is applied, the user may nevertheless remove broadhead 200 and replace it as desired.

In another embodiment, the nylon polymer or chemical is pre-applied to the internal bore portion 306 of arrow insert 300. Referring to FIG. 3, the nylon polymer 310 is applied to part of the threaded portion 308 of internal bore portion 306 of arrow insert 300. In the alternative, nylon polymer 310 may be applied to the entire surface area of threaded portion 308 of internal bore portion 306 of arrow insert 300, providing 360 degree coverage.

If pre-application of a nylon polymer or suitable chemical substitute on the threaded portion 308 of internal bore portion 306 of arrow insert 300 is provided to create a self-locking field tip or broadhead arrow system, then application of the nylon polymer to the threaded end of field tip 100 or broadhead 200 is not required. Similarly, if the nylon polymer or suitable chemical substitute is applied to field tip 1000 broadhead 200 as depicted in FIGS. 1 and 2, then application of the nylon polymer or suitable chemical substitute to the arrow insert 300 is not required.

Although the claimed subject matter has been described with a certain degree of particularity, it should be recognized that elements thereof may be altered by persons skilled in the art without departing from the spirit and/or scope of claimed subject matter. It is believed that the subject matter pertaining to archery arrow tips and inserts will be understood by the forgoing description, and it will be apparent that various changes may be made in the form, construction and/or arrangement of the components thereof without departing from the scope and/or spirit of the claimed subject matter or without sacrificing all of its material advantages, the form herein before described being merely an explanatory embodiment thereof, and/or further without providing substantial change thereto. It is the intention of the claims to encompass and/or include such changes.

What is claimed:

1. A self-locking archery arrow system, comprising:

an arrow body portion having a front end;

an arrow tip having a shank portion and a threaded end;

an arrow insert having an internal shaft and an internal threaded section coupled to the front end of the arrow body portion; and a coating associated with the threaded end of the arrow tip, wherein the threaded end of said arrow tip is inserted into the internal shaft of the arrow insert and detachably and reusably engaged by the threaded section of the arrow insert.

2. The self-locking archery arrow system of claim 1, wherein the coating is a nylon polymer coating thermally or chemically pre-applied to the threaded end of the shank portion.

3. The self-locking archery arrow system of claim 2, wherein the arrow tip is a field tip.

4. The self-locking archery arrow system of claim 2, wherein the arrow tip is a broadhead.

5. The self-locking archery arrow system of claim 1, wherein the coating is a nylon polymer coating thermally or chemically pre-applied to the internal threaded section of the arrow insert.

6. The self-locking archery arrow system of claim 5, wherein the arrow tip is a field tip.

7. The self-locking archery arrow system of claim 5, wherein the arrow tip is a broadhead.

8. The self-locking archery arrow system of claim 1 wherein the coating is a chemical pre-applied to the threaded end of the shank portion or the internal threaded section of the arrow insert.

9. A self-locking archery arrow tip, comprising:

a tip portion;

a shank portion; and a coated threaded end coupled to the shank portion, wherein the coated threaded end is sized to be detachably and reusably engaged under normal operation to an internal threaded arrow insert.

10. The self-locking archery arrow tip of claim 9, wherein the arrow tip is a field tip.

11. The self-locking archery arrow tip of claim 10, wherein the coating is a thermally or a chemically pre-applied nylon polymer.

12. The self-locking archery arrow tip of claim 10, wherein the coating is a pre-applied chemical coating.

13. The self-locking archery arrow tip of claim 9, wherein the arrow tip is a broadhead.

14. The self-locking archery arrow tip of claim 13, wherein the coating is a thermally or a chemically pre-applied nylon polymer.

15. The self-locking archery arrow tip of claim 13, wherein the coating is a pre-applied chemical coating.

16. A self-locking archery arrow insert for insertion into a front end of an arrow shaft, comprising:

a lip section;

an internal shaft;

an internal threaded section of the internal shaft sized to be detachably and reusably engaged under normal operation to a threaded end of an archery arrow tip;

and a coating associated with the internal threaded section.

17. The self-locking archery arrow insert of claim 16, wherein the coating is a thermally or a chemically pre-applied nylon polymer.

18. The self-locking archery arrow insert of claim 16, wherein the coating is a pre-applied chemical coating.

* * * * *